United States Patent [19]

Medcalf

[11] 4,286,969

[45] Sep. 1, 1981

[54] HYDROCARBON FUEL ADDITIVE

[75] Inventor: Eugene C. Medcalf, Bound Brook, N.J.

[73] Assignee: BWM Corporation, Mount Vernon, N.Y.

[21] Appl. No.: 890,552

[22] Filed: Mar. 20, 1978

[51] Int. Cl.[3] ..... C10L 1/18

[52] U.S. Cl. ..... 44/53; 44/56; 44/57; 44/77; 44/79

[58] Field of Search ..... 44/53, 57, 77, 79, 56

[56] References Cited

U.S. PATENT DOCUMENTS

| | | | |
|---|---|---|---|
| 2,380,341 | 7/1945 | Sowers | 44/57 |
| 2,631,929 | 3/1953 | Thorpe et al. | 44/79 |
| 2,785,662 | 3/1957 | Boyce | 44/57 |
| 2,912,313 | 11/1959 | Hinkamp et al. | 44/57 |

*Primary Examiner*—Winston A. Douglas
*Assistant Examiner*—J. V. Howard
*Attorney, Agent, or Firm*—Robert W. Kell

[57] ABSTRACT

A solution of a halogenated hydrocarbon when added in amounts of from about 1 to 2 parts per thousand to hydrocarbon fuels improves combustion and increases fuel efficiency. The presence of a small amount of a hydroperoxide in combination with the halogenated hydrocarbon improves the starting characteristics of diesel fuel and further improves combustion efficiency.

9 Claims, No Drawings

HYDROCARBON FUEL ADDITIVE

The present invention relates broadly to hydrocarbon fuel additives and more particularly to solutions that contain:

1. A halogenated hydrocarbon
2. A hydroperoxide
3. Naphthalene or an alkyl substituted naphthalene, and
4. An organic solvent that is miscible with hydrocarbon fuels, i.e. an alkyl ether of diethylene glycol.

When the halogenated hydrocarbon present in the additive composition is a halogenated napthalene it may replace the naphthalene normally present in solution. If the additive is to be combined with gasoline as the hydrocarbon fuel, the hydroperoxide may be eliminated from the formulation.

The market for fuel additives that improve combustion has been increasing since the oil embargo of 1973. Many such products have been formulated to disperse and reduce sludge formation, to modify ash formation, to eliminate soot and to minimize slag and pollution problems. Organic metallic compounds have also been used as combustion catalysts to improve fuel efficiency. Manganese is the preferred combined metal, although magnesium, cobalt, iron, barium and nickle are also considered effective.

The use of glycol ethers and particularly the ethers of ethylene glycol and diethylene glycol are described in U.S. Pat. No. 2,184,956 as improving the anti-knock properties of gasoline. U.S. Pat. No. 3,061,420 teaches the addition of a $C_1$ to $C_4$ monoalkyl ether of mono or di-ethylene glycol as an anti-icing agent.

The addition of naphthalene to improve the properties of hydrocarbon fuels is taught in U.S. Pat. No. 1,092,461; 1,587,899; 1,684,686; 2,106,661 and 3,925,031.

The present invention involves the discovery that the combustion of hydrocarbon fuels such as fuel oil, diesel oil and gasoline is markedly improved by the addition of a small amount, i.e., one to two parts per thousand, of a solution that contains:

1. A halogenated hydrocarbon
2. A hydroperoxide
3. Naphthalene or an alkyl substituted naphthalene, and
4. An organic solvent that is miscible with hydrocarbon fuels, i.e. an alkyl ether of diethylene glycol.

When the halogenated hydrocarbon present in the additive composition is a halogenated naphthalene it may replace the naphthalene normally present in solution. If the additive is to be combined with gasoline as the hydrocarbon fuel, the hydroperoxide may be eliminated from the formulation.

Halogenated hydrocarbons that are suitable for use in the present inventions are the chlorinated aromatic hydrocarbons such as mono-, di-, or trichlorobenzene; mono-, di-, or trichloro toluene, the chlorinated xylenes, naphthalenes, anthracenes, etc. The corresponding aromatic bromo- and iodo- compounds are also effective although more costly. The halogenated aliphatic compounds such as 1,1-dichloroethylene; 1,2-dichloroethylene; 1,2-dibromoethylene; 1-bromo-2-methyl butane; and 1-chlorobutane are also useful although more corrosive than the aromatic series. Particularly preferred in the additive mixtures of the present invention are chlorobenzene, dichlorobenzene, 1,3-dichloronaphthalene; 1,4-dichloronaphthalene; 1,5 dichloronaphthalene; 2,3-dichloronaphthalene; 2,6-dichloronaphthalene; and 1,2,3,4-tetrachloro-1,2,3,4-tetrahydronaphthalene.

For convenience in mixing the additive with the fuel, solutions of the halogenated hydrocarbons are prepared by dissolving in a miscible organic solvent such as methanol or a $C_1$ to $C_4$ mono alkyl ether of mono- or diethylene glycol.

The amount of halogenated hydrocarbon that is present in the additive composition may vary from as little as 1.0 weight percent to as much as about 66 weight percent.

Hydroperoxides that are suitable for use in the present invention are cumene hydroperoxide and tertiary butyl hydroperoxide. Acyl hydroperoxides such as benzoyl peroxide are less preferred. The hydroperoxide used should be chosen with stability factors in mind to avoid unnecessary hazzards and should not be combined with unsaturated aliphatic compounds under any circumstances. The amount of hydroperoxide that is present in the additive composition may vary from 0.1 weight percent (when the fuel is gasoline) to as much as about 10 weight percent.

The amount of naphthalene (or alkyl substituted naphthalene) that is present in the additive composition of the present invention may vary from 0 (when the halogenated hydrocarbon is a halogenated naphthalene) to as much as about 25 weight percent. When naphthylene per se is present in said composition, it is preferred that the ratio of naphthylene to halogenated hydrocarbon be in the range of from about 1:2 to about 1:1. The higher quantities of naphthalene may require additional solvents to prevent precipitation or clouding at low temperatures.

The utility of the additive of the present invention will become apparent from the following Examples wherein all parts are expressed as parts by weight unless otherwise stated.

EXAMPLE 1

A fuel oil additive is prepared having the following composition:

Dichlorobenzene: 30 parts
Methyl Alcohol: 52 parts
Naphthalene: 15 parts
Cumene hydroperoxide: 3 parts One part by volume of this mixture is added with stirring to 20 parts by volume of No. 2 fuel oil and the diluted composition is then mixed thoroughly with 980 parts by volume of No. 2 fuel oil. A comparative test in firing a boiler with the treated No. 2 fuel oil containing the additive and a control sample of the same fuel oil that had not been so treated indicated a 5% improvement in combustion efficiency.

EXAMPLE 2

A diesel oil additive is prepared having the following composition:

Dichlorobenzene: 43 parts
Naphthalene: 21 parts
Cumene hydroperoxide: 4 parts
Methyl alcohol: 32 parts One part by volume of this mixture is added with stirring to 20 parts by volume of diesel oil and the diluted composition is then mixed thoroughly with 980 parts by volume of diesel oil. The treated diesel oil was evaluated in a Mercedes diesel car. The additive substantially improved cold weather starting and resulted in an 8% increase in mileage over diesel oil that contained no additive.

EXAMPLE 3

A gasoline additive is prepared having the following composition:

Dichlorobenzene: 44 parts

Naphthalene: 22 parts

2(2-n-butoxy-ethoxy)ethanol: 34 parts

One part by volume of this additive is mixed with 1,000 parts by volume of gasoline. A comparative test between the treated gasoline containing the additive and a control sample of the same gasoline that had not been so treated in a 1968 Pontiac sedan showed a 90 percent reduction in hydrocarbon emissions when the treated gasoline was substituted for the untreated gasoline.

EXAMPLE 4

A fuel additive is prepared having the following composition:

1,3-dichloronaphthalene: 60 parts

Tertiary butyl hydroperoxide: 3 parts

2(2-n-butoxy-ethoxy)ethanol: 37 parts

Two parts by volume of this composition is added to 1,000 parts by volume of #6 fuel oil. The resulting product increased boiler efficiency by minimizing operating difficulties and substantially reduced sludge formation.

The above additive also improves the combustion efficiency of coke oven coal tar when present in concentrations of two parts per thousand.

Although the invention has been described with a certain degree of particularity, the scope of the invention is not to be limited to the details set forth but should be given the full breath of the appended claims.

What is claimed is:

1. An additive for use with a hydrocarbon fuel which comprises a solution of a halogenated hydrocarbon containing from about 0.1 to about 10 percent by weight of a hydroperoxide and a compound selected from the group consisting of naphthylene, halogenated naphthylene and alkyl derivatives of naphthylene.

2. The additive of claim 1 wherein the halogenated hydrocarbon is a halogenated aromatic hydrocarbon.

3. The additive of claim 1 wherein said solution contains naphthylene.

4. The additive of claim 3 wherein the weight ratio of naphthalene to said halogenated hydrocarbon is in the range from about 1:2 to about 1:1.

5. The additive of claim 1 wherein the hydroperoxide is cumene hydroperoxide.

6. The additive of claim 1 wherein the hydroperoxide is tertiary butyl hydroperoxide.

7. The additive of claim 1 wherein the halogenated hydrocarbon is a halogenated naphthalene.

8. The additive of claim 7 wherein the halogenated naphthalene is 1,3-dichloronaphthalene.

9. The additive of claim 1 wherein the halogenated hydrocarbon is dissolved in 2(2-n-butoxy-ethoxy)ethanol.

* * * * *